US006217007B1

(12) United States Patent
Grayson, II et al.

(10) Patent No.: US 6,217,007 B1
(45) Date of Patent: Apr. 17, 2001

(54) FENCE SYSTEM

(75) Inventors: Henry C. Grayson, II; Frank H. Wright, both of Plano, TX (US)

(73) Assignee: Concepts-To-Market, Inc, Dallas, TX (US)

( * ) Notice: Subject to any disclaimer, the term of this patent is extended or adjusted under 35 U.S.C. 154(b) by 0 days.

(21) Appl. No.: 09/261,936

(22) Filed: Mar. 3, 1999

(51) Int. Cl.[7] ..... E04H 17/16
(52) U.S. Cl. ..... 256/24; 256/12.5
(58) Field of Search ..... 256/59, 65, 24, 256/67, 21, 22, 1, 25, 12.5, 26

(56) References Cited

U.S. PATENT DOCUMENTS

| | | | | |
|---|---|---|---|---|
| 24,373 | * | 6/1859 | Cadwell | 256/65 |
| 173,403 | * | 2/1876 | Hafele | 256/24 |
| 250,573 | * | 12/1881 | Potter | 256/59 |
| 325,357 | * | 9/1885 | Ogilvie | 256/59 |
| 417,077 | * | 12/1889 | Osborn et al. | 256/59 |
| 447,204 | * | 2/1891 | Rife | 256/65 X |
| 1,024,858 | * | 4/1912 | Kissinger et al. | 256/59 |
| 2,927,779 | * | 3/1960 | Umberger | 256/59 X |
| 2,973,943 | * | 3/1961 | Loter et al. | 256/24 X |
| 3,963,219 | * | 6/1976 | D'Amico | 256/37 X |
| 4,666,131 | * | 5/1987 | Kettelkamp, Sr. et al. | 256/59 |
| 4,938,445 | * | 7/1990 | Medley | 256/65 |
| 5,913,508 | * | 6/1999 | Eades | 256/67 X |

* cited by examiner

*Primary Examiner*—Harry C. Kim
(74) *Attorney, Agent, or Firm*—John E. Vandigriff

(57) ABSTRACT

A fence system has fence posts, or attachments to fence posts, which have slots that hold a plurality of horizontal fence elements without the aid of screws or nails. A plurality of the horizontal fence elements are placed in individual slots, one above the other to form the fence between posts. The slots are positioned along the posts so that the horizontal fence elements overlap preventing one from looking through the fence between horizontal elements. The horizontal fence elements may be slightly incline to permit air to circulate through the fence.

19 Claims, 10 Drawing Sheets

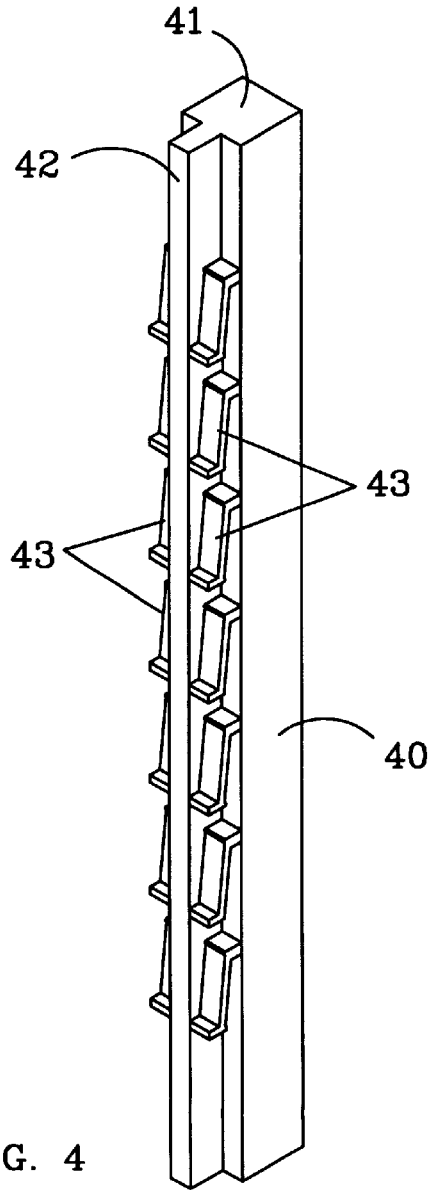
FIG. 4
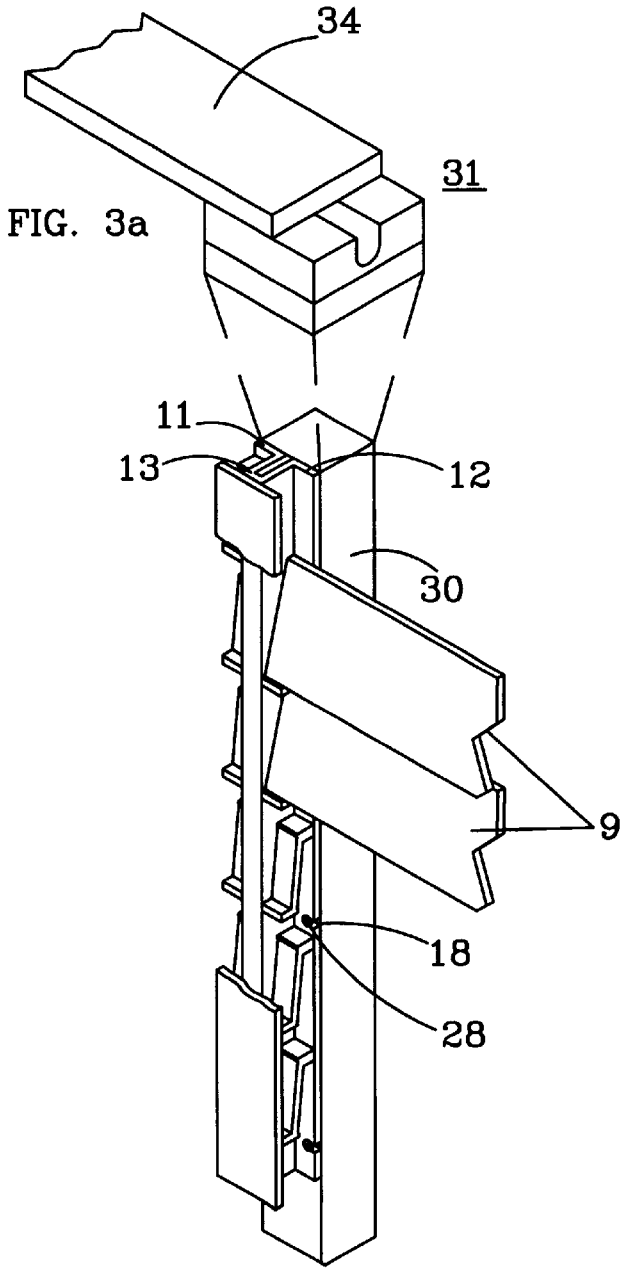
FIG. 3a
FIG. 3

FENCE SYSTEM

FIELD OF THE INVENTION

The invention relates to fence systems, and more particularly to a fencing system that allows horizontal fence slats to be mounted on the fence posts without fasteners.

BACKGROUND OF THE INVENTION

Fence systems are usually constructed by placing post in the ground along the perimeter of the fence, and then horizontal members are secured between post on which vertical fence members are attached to complete the fence. Other systems may include fence posts and a plurality of horizontal fence members secured between post. Both types of fence construction require that both the vertical and horizontal fence members be secured to other fence members, including the posts, with nails or long screws.

U.S. Pat. No. 4,492,307, shows mounting devices for mounting preconstructed fence panels. The mounting devices are secured to the fence post and to one side of the fence panel to mount the panel between two post. The panels have to be preconstructed and consume a lot of time in being assembled.

U.S. Pat. No. 5,611,523, describers a fence system in which horizontal fence rails extend through the posts and are utilized to provide a double fence system where vertical fence member are on both sides of the fence. In order to eliminate the necessity of having to drill through the fence post to provide openings through which top and bottom rails extend, a connector is described having two c-shaped parts that provides a support for the upper fence rail.

In the above and other prior art fence systems, it is time consuming to assemble the fence members to form panels, or secure the vertical fence members to horizontal rails to assemble the fence. Even when preassembled panels are used, the panels have to be assembled prior to mounting them on fence rails and posts.

SUMMARY OF THE INVENTION

The invention is a fence system in which fence posts or attachments to fence post have slots that hold a plurality of horizontal fence elements without the aid of screws or nails. A plurality of the horizontal fence elements are placed in individual slots, one above the other to form the fence between posts. The slots are positioned along the posts so that the horizontal fence elements overlap preventing one from looking through the fence between horizontal elements. The horizontal fence elements may be slightly incline to permit air to circulate through the fence.

The slots in which the horizontal fence elements are placed in an elongated attachment that is attached to a fence post, or may be included in the fence post. A top rail is positioned over the fence along its length and fastened at it ends to the fence post. Fascia boards may be attached to the top rail board. The top rail and fascia boards form an enclosed area along the top of the fence. Electric lighting and/or watering misting systems may be placed in the enclosed area along the top of the fence. Double faced fences may be constructed by mounting an elongated attachment to opposites sides of the fence post, and elongated attachments are on adjacent sides of a fence post at the corner of a fence.

Various other objects may be mounted on the fence using fingered mounts that hold the object on the fence.

BRIEF DESCRIPTION OF THE DRAWINGS

FIG. 3 shows a fence attachment device attached to a square fence post;

FIG. 3*a* shows the to rail attachment device;

FIG. 4 shows a combination fence attachment device and fence post;

DESCRIPTION OF A PREFERRED EMBODIMENT

Figure 1:
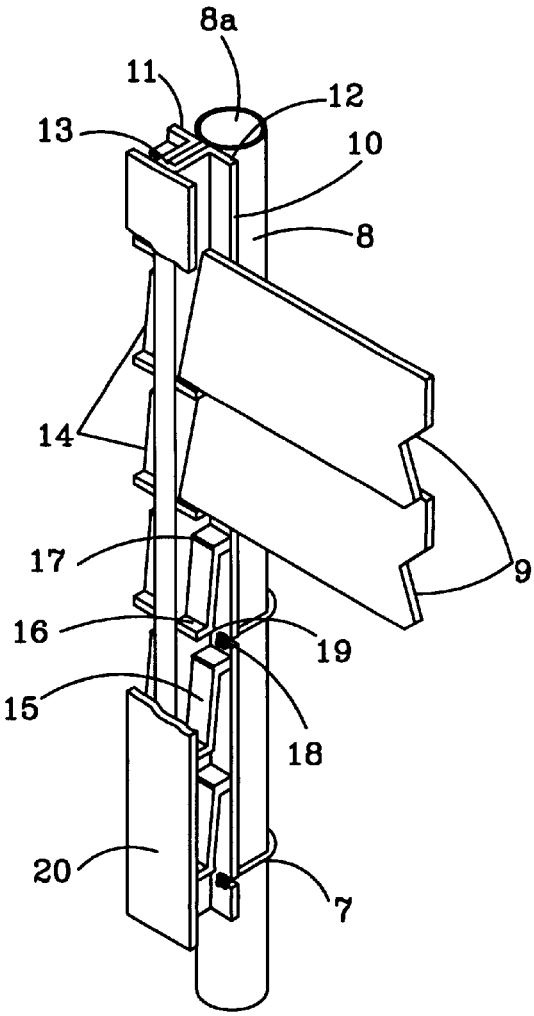
FIG. 1 shows a fence attachment device mounted on a fence post.
Figure 1A:
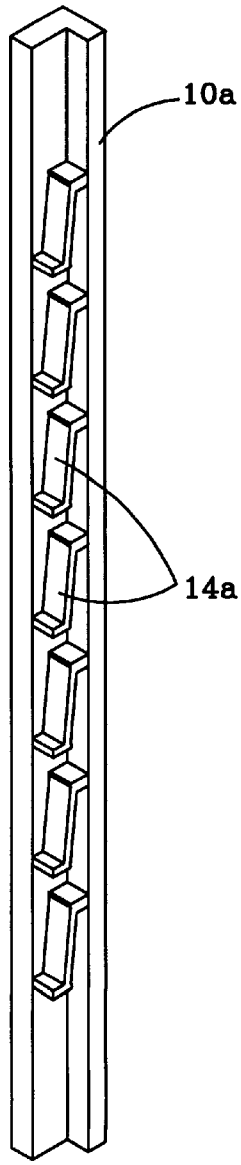
FIG. 1*a* shows a fence post with a single column attachment device.

FIG. 1 shows a fence attachment device 10 mounted on a fence post 8 with U-bolts 7 extending though openings 18 positioned along the length of attachment 10 through sides 11 and 12. Fence rails or slats 9 are mounted in a plurality of mounts 14 spaced along device 10. Each end of fence slats 9 are placed in mounts 14 between adjacent fence poles. Each end of a fence slat 9 is placed against a surface 15 of each mount device 14, resting on lip 16 and held between projections 17 and 19, projection 17 being on the surface 15 against which the fence slat 9 is placed, and projection 19 is on the back of the mount immediately above the mount in which the slat is mounted. An extended member 13 separates two vertical rows of mount devices 14. Slats 9 are mounted in each set of mount devices, and are separated by extended member 13. A panel 20 is then attached to extension 13 to cover the end of the slats 9 and to hold slats 9 in position. Extension 13 is U-shaped with an opening 13*a* extending the length of extension 13 separating the two legs of the U-shape. This permits attachment device to be separated into two parts as illustrated in FIG. 1*a*. Only one-half of attachment device 10 is use at the end of a fence or corner of a fence. FIG. 1*a* shows one-half of attachment 10 with a plurality of mounts 14*a*, for example, that would be used on a post at the end of a fence.

Figure 1B:
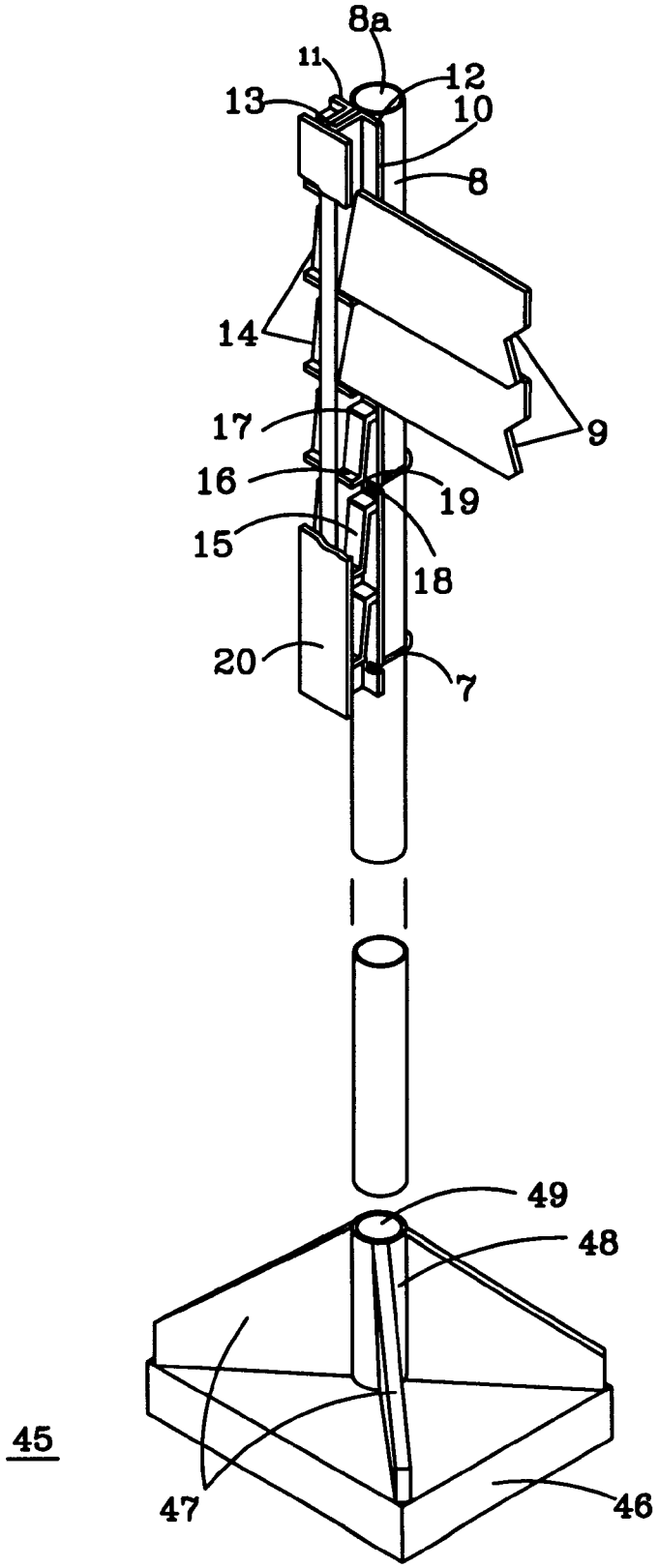
FIG. 1*b* shows a stand-alone movable fence post.

FIG. 1*b* shows a stand-alone fence post mounted in a base 45. Base 45 has an tube 48 with an opening 49 slightly larger than post 8, and into which post 8 is placed. Base 45 has four braces 47 placed around tube 48 for support. Base 45 and post 8 would be used, for example, for movable fences that are placed around garbage cans, storage areas, and temporary fenced areas.

Figure 2:
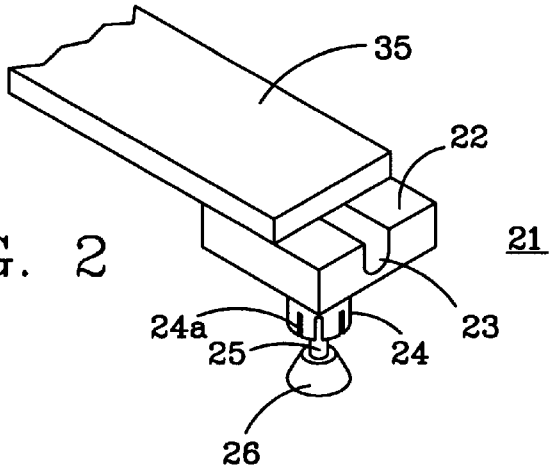
FIG. 2 shows the connection of the top rail to the fence post.

FIG. 2 shows a post cap 21 to which a top rail can be mounted along the fence. Cap 21 has a rectangular block 22 with a cylindrical insert 24 mounted on its underside. Insert 22 has openings 24*a* along it side extending from the bottom edge. Mounted below insert 33 is a conical wedge 26 mounted on screw 25 extending from the top of block 22 through the center of insert 24. When cap 21 is mounted on post 8 with insert 24 and wedge 26 in the opening 8*a* of post 8, and screw 25 is turned, wedge 26 is drawn up into insert 24 spreading the ends separated by openings 24*a* locking post cap 21 on the top of post 8. Post cap 21 is further described in FIGS. 11 and 12, below.

The fence attachment is illustrated in FIG. 3 is attached to a square or rectangular post 30 by screws or bolts 28 extending through opens 18 along the length of attachment 10. Since post 30 is not hollow, cap 31 (FIG. 3*a*)is attached to the top of post 30 by, for example, by screws or nails (not illustrated).

FIG. 4 illustrates a combination fence post 40 that includes the post 41 and the mounting device 43. Extension 42 divides the post into to sides with mounting devices 43 on each side. Post 30 may be formed with only one vertical column of mounting devices 43, as illustrated in FIG. 1*a*, or on adjacent sides of post 40 to be used as a corner post of a fence.

Figure 5:
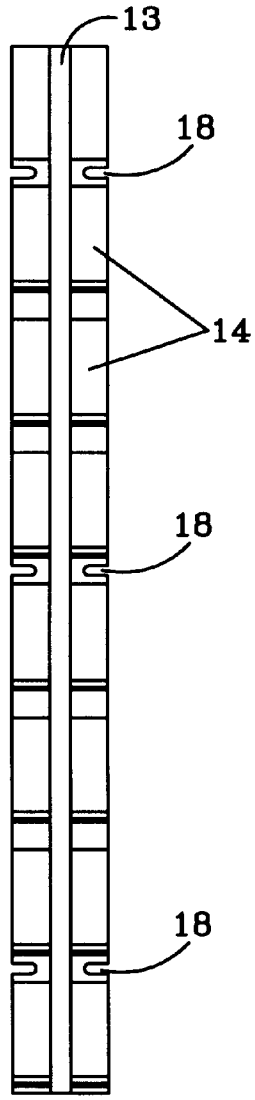
FIG. 5 is a front view of the fence attachment device.

FIG. 5 is a front view of attachment device 10, showing the mounting holes 18 located in three positions along the length of device 10. There may me more or less mounting holes, depending upon the length of device 10, and the mounting holes may be slotted as shown or may be simple openings.

Figure 6:
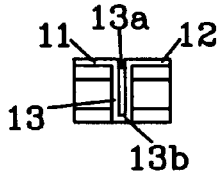
FIG. 6 is an end view of the fence attachment device.

FIG. 6 is an end view of device 10, showing the U-shape of the device. Device 10 may be separated at 13*b* to provide two mounting devices such as would be used at the end of a fence, for example, side 11 would be at the left end of a fence, and side 12 would be at the right end of a fence. Each half may also be made separate as illustrated in FIG. 1*a*.

Figure 7A:
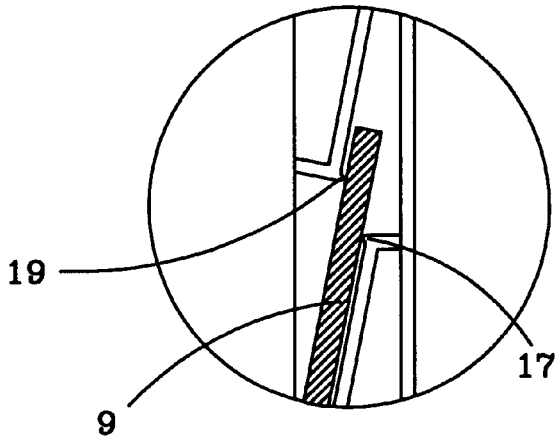
FIG. 7*a* is an enlarged view of a portion of the fence attachment device.
Figure 7:
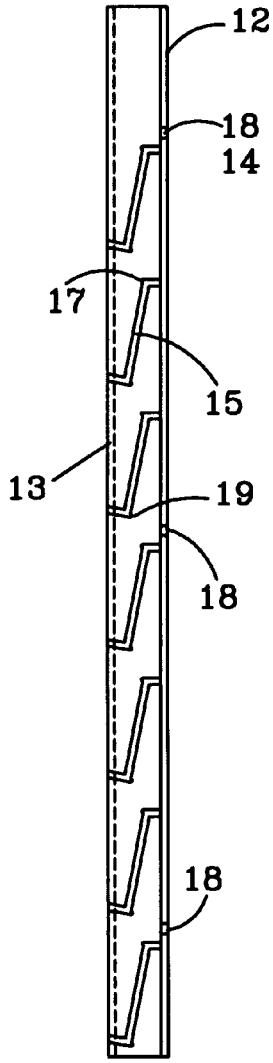
FIG. 7 is a side view of the fence attachment device.

FIG. 7 is a side view showing the inclined mounting devices 14 with the projections 17 and 19 which hold a slat in position. An enlarged view of projections 17 and 19 with a slat 9 positioned between them is shown in FIG. 7*a*.

Figure 8:
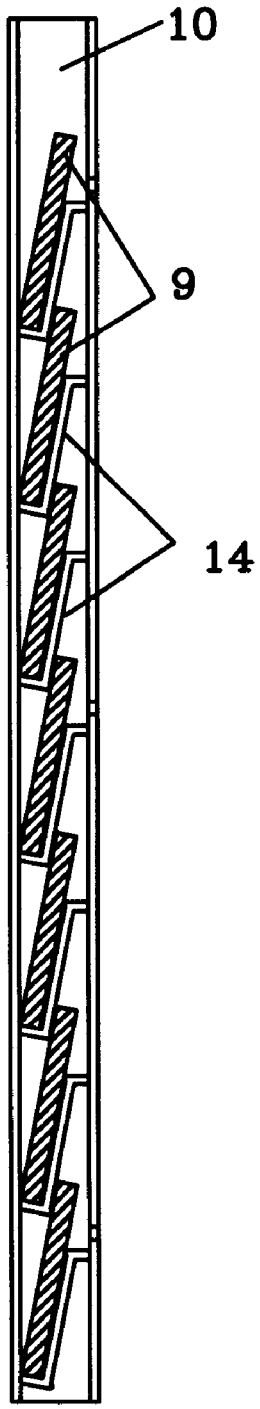
FIG. 8 is a side view of the fence attachment showing fence rails mounted in the mounting slots.
Figure 8A:
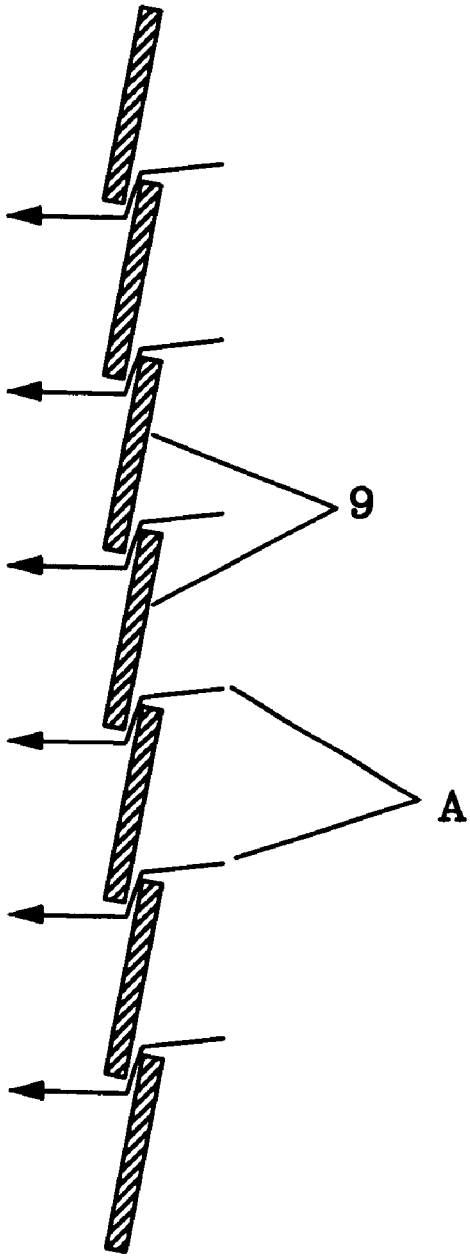

FIG. 8 is a side view showing the fence slats 9 in position in device 10. Each slat 9 over laps the one below and above it to prevent seeing through the fence. In FIG. 8*a*, only the slats 9 are shown. Even though one cannot see through the fence air can circulate through the fence as indicated by arrows A.

Figure 9:
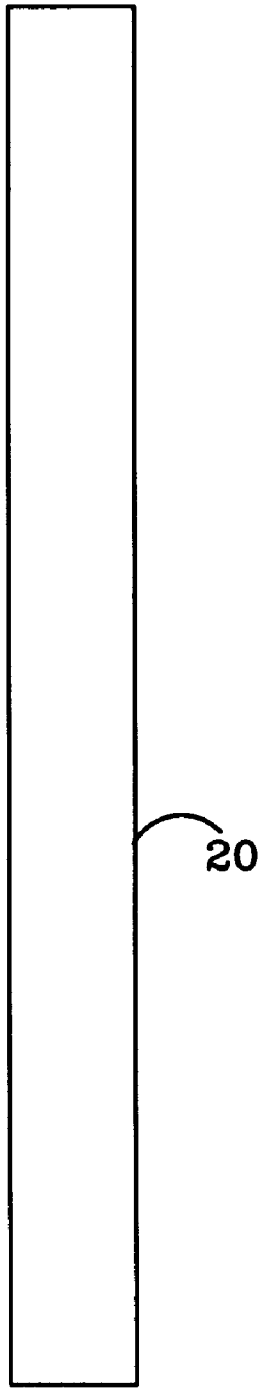
FIG. 9 is a front view of the front trim for the fence attachment device.
Figure 10:
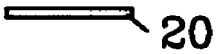
FIG. 10 is a side view of the front trim for the fence attachment device.

FIGS. 9 and 10 show the panel 20 that is attached to part 13 of device 10 (FIG. 1) to hold the fence slats 9 in position.

Figure 11:
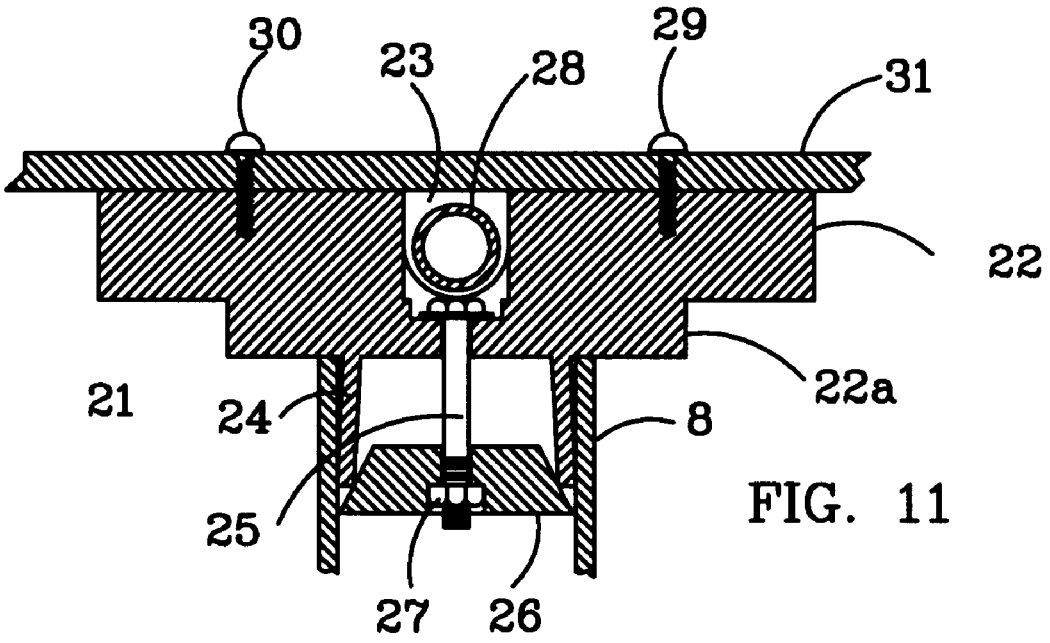
FIG. 11 is a cross-section view of the device, shown in FIG. 2, for connecting the top rail to a post.

FIG. 11 is a cross-sectional view of post cap 21, initially illustrated in FIG. 2. Cap 21 has a rectangular block 22, a stepped down section 22*a*, and a cylindrical insert 24 extending from section 22*a*. Insert 24 has a plurality of openings 24*a* (FIG. 2) along it side extending from the bottom edge. Mounted below insert 24 is a conical wedge 26 mounted on screw 25, held in place by nut 27, extending from the top of block 22 through the center of insert 24. When cap 21 is mounted on post 8 with insert 24 and wedge 26 in the opening 8*a* of post 8 (FIG. 2), and screw 25 is turned, wedge 26 is drawn up into insert 24 spreading the ends of inserts 24, separated by openings 24*a*, locking post cap 21 on the top of post 8. Pipe 28 extends through recess 23.

Figure 12:
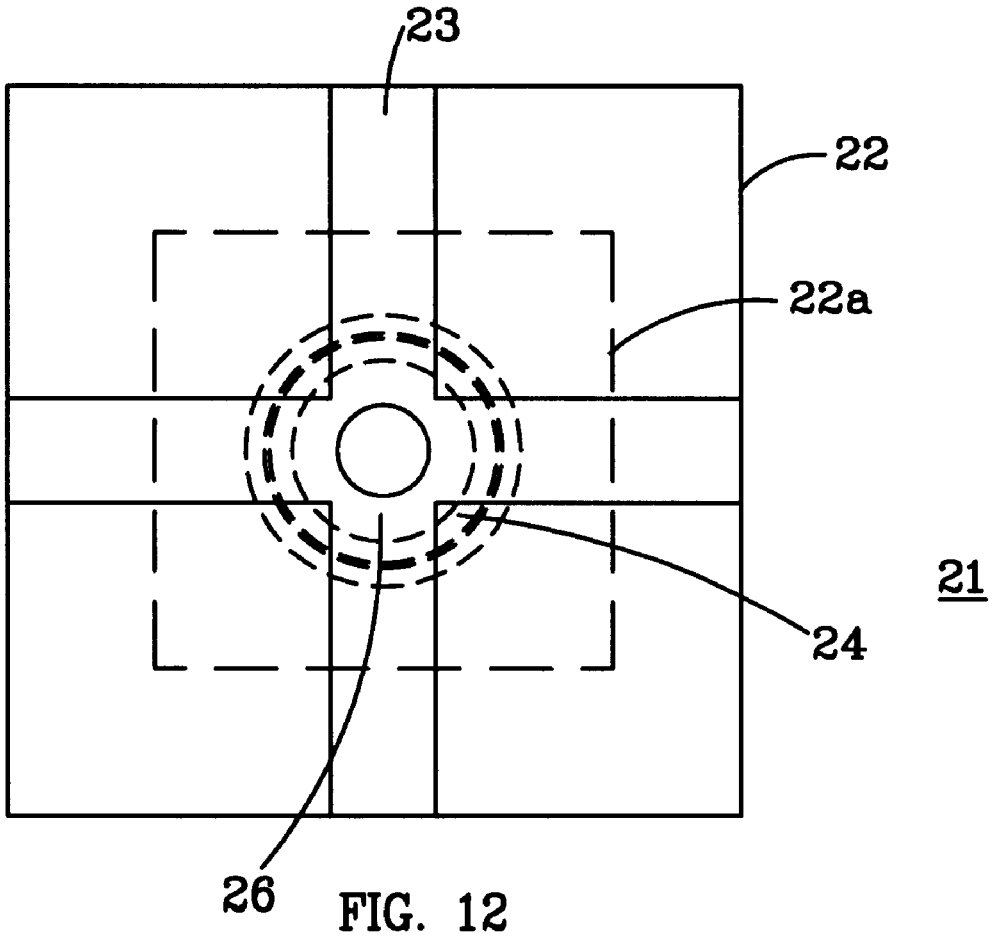
FIG. 12 is a top view of the device of FIG. 11.

FIG. 12 is a top view of cap 21 showing the block 22 and stepped down section 22*a*. Insert 24 and wedge 26 are shown in post 8.

Figure 13:
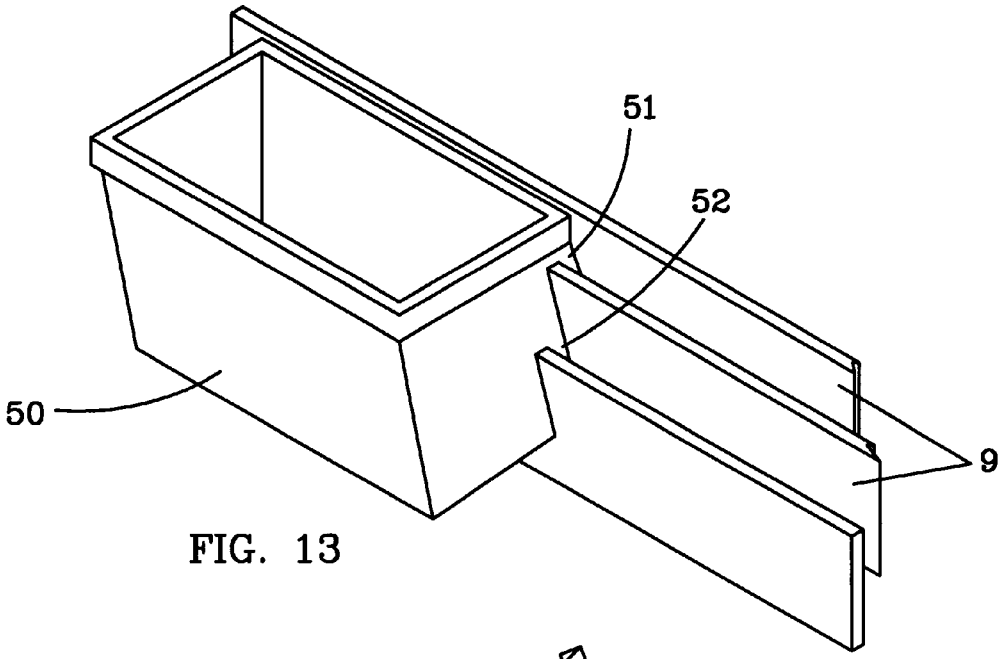
FIG. 13 shows a container attached to the fence rails.
Figure 14:
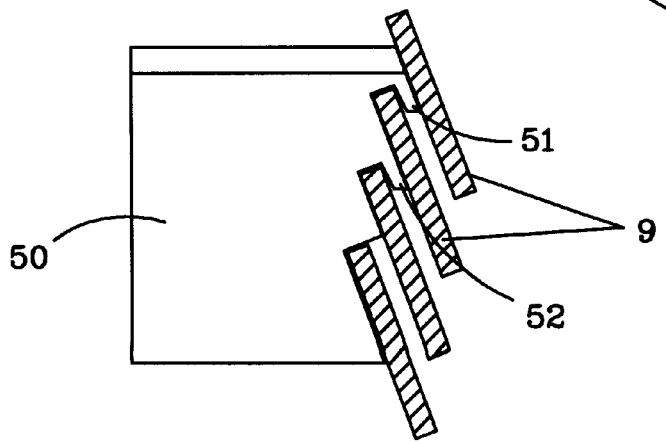
FIG. 14 is a side view of the container attached to the fence rai1s.
Figure 16:
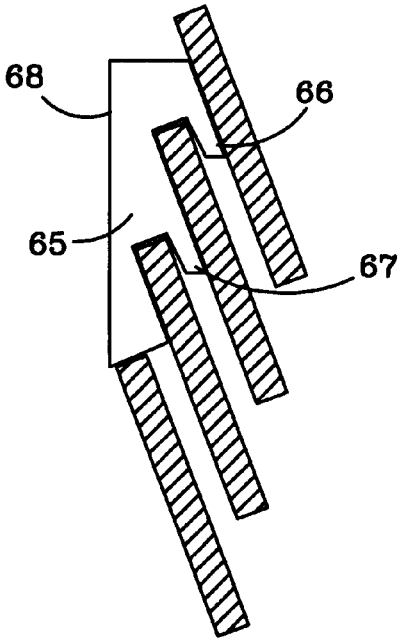
FIG. 16 shows a universal attachment device for attaching objects to the fence.

Various accessories may be mounted on the fence system according to the present invention. FIGS. 13 and 14 show a container 50 that may be attached to fence slats 9 by projections 51 and 52 which may integral with the container, or may be a separate device as discussed below with reference to FIG. 16. Projections 51 and 52 are inserted into the space between inclined fence slats 9. Container 50 may be a flower box, or with the addition of a lid may be used to store garden tools and other objects.

Figure 15:
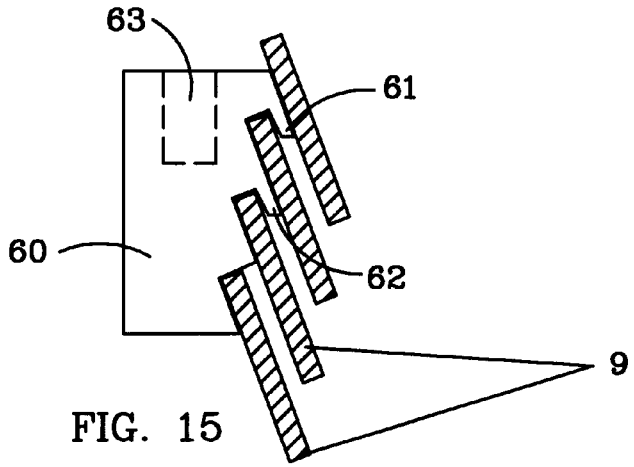
FIG. 15 shows a second embodiment of a holder attached to the fence.

An example of another accessory is illustrated in FIG. 15. Accessory 60 has projections 61 and 62 similar to projections on container 50 which are placed in the space between fence slats 9. Accessory 60 may have an opening 63 in the top which may a hold, for example, a flag pole or a pole supporting a bird house or bird feeder.

Each of FIGS. 14–15 illustrate an accessory device for attaching to the fence system. FIG. 6 shows a universal attachment device 65 that has projections 66 and 67 which are inserted into fence slats 9. Device 65 has a face 68 to which an accessory may be attached by screws or any other means.

The accessories may be attached at any position of the fence, since the spacing of the slats 9 are uniform and the projections may be placed into any two openings between slats.

Figure 18:
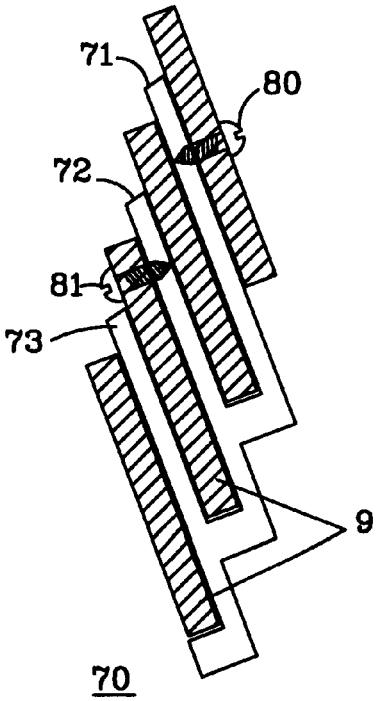
FIG. 18 shows the support clip mounted between fence rails.
Figure 17:
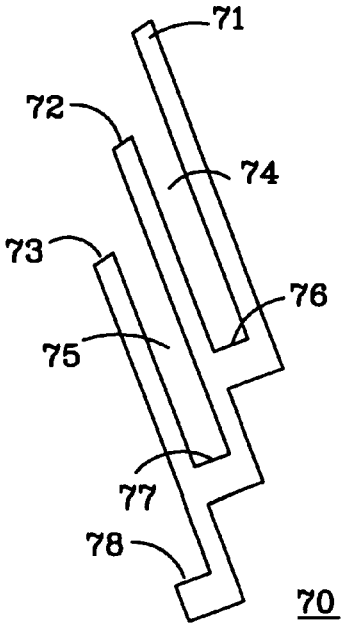
FIG 17 shows a support clip for supporting the middle portions of the fence rails.

Depending upon the length of the slats between fence post, it may be necessary or desirable to support the middle portion of the slats midway between fence posts. Support is desired when accessories are attached to the middle portion of a fence span. FIGS. 17 and 18 show a support device that may be inserted up between slats to support the mid sections of the fence slats. In FIG. 17, device 70 has a plurality of fingers 71-13 that are inserted into the spaces between fence slats, with the slats in openings in 74-74 and resting on shoulders 76-78. This is illustrated in FIG. 18 where slats 9 are secured to support 70 by screws 80 and 81. The support device 70 has been illustrated supporting only three slats 9, but support device may be as long as necessary, having as may fingers and shoulders necessary to support as many slats 9 as desired.

Figure 19:
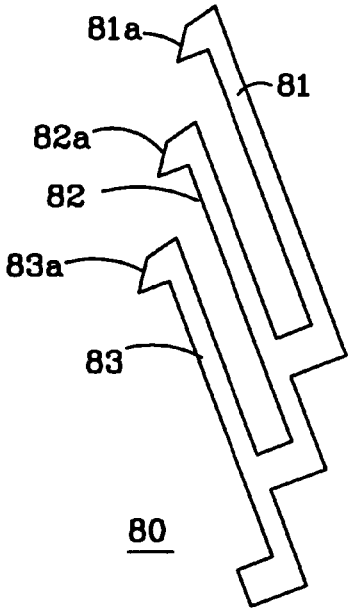
FIG. 19 shows a second embodiment of a support clip.

FIG. 19 shows a self-attaching support. Support 80 which has, for example, three fingers 81–83. Each finger has an end, 81*a*, 82*a* and 83*a*, extending 90 degrees from its respective finger. Fingers 81–83 are inserted between slats until the ends 81*a*–83*a* snaps over the top of the slat, locking the support into place.

Figure 20:
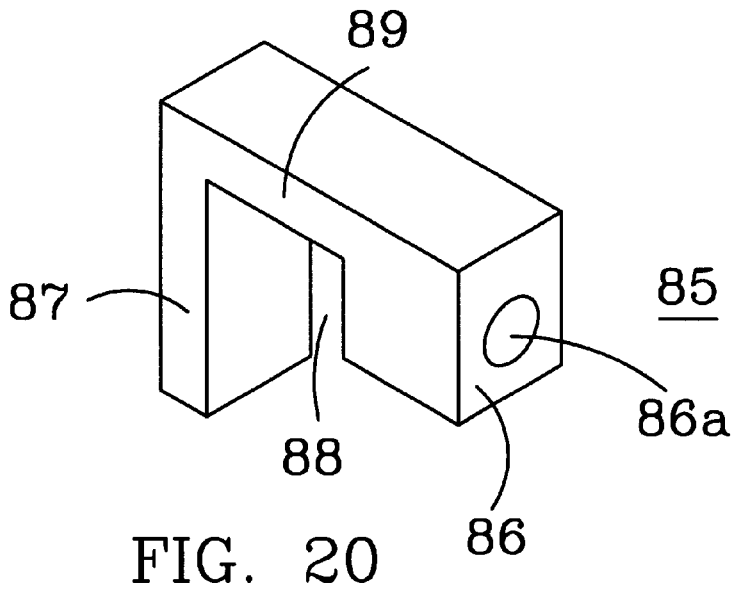
FIGS. 20 and 21 show a single clip to be placed between two fence slats.
Figure 21:
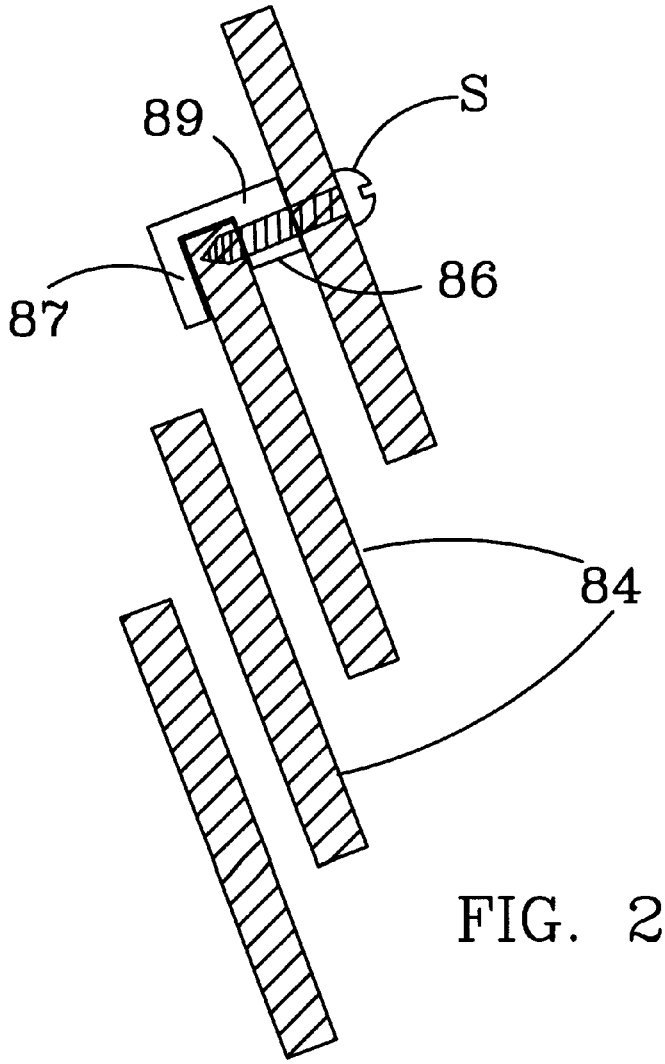

FIGS. 20 and 21 illustrate a brace 85 to be used between two fence slats. FIG. 20 is an isometric view in which brace 85 is U-shaped with a block end 86 separated by end 87 by a transition part 89. The open part of the U-shape is show as 88. A screw may be inserted into opening 86*a* in block end 86 so secure brace 85 to the slats 84*a* and 84*b* (FIG. 21).

In FIG. 21, brace 85 is positioned with block end 86 inserted between two fence slats 84*a* and 84*b*, with transition part 89 over the top of fence slat 84*b* and end 87 extend at an angle of ninety degrees to transition part 89. Slat 84 is in opening 88. A screw S secures end 86 to fence slat 84*a*

Figure 22:
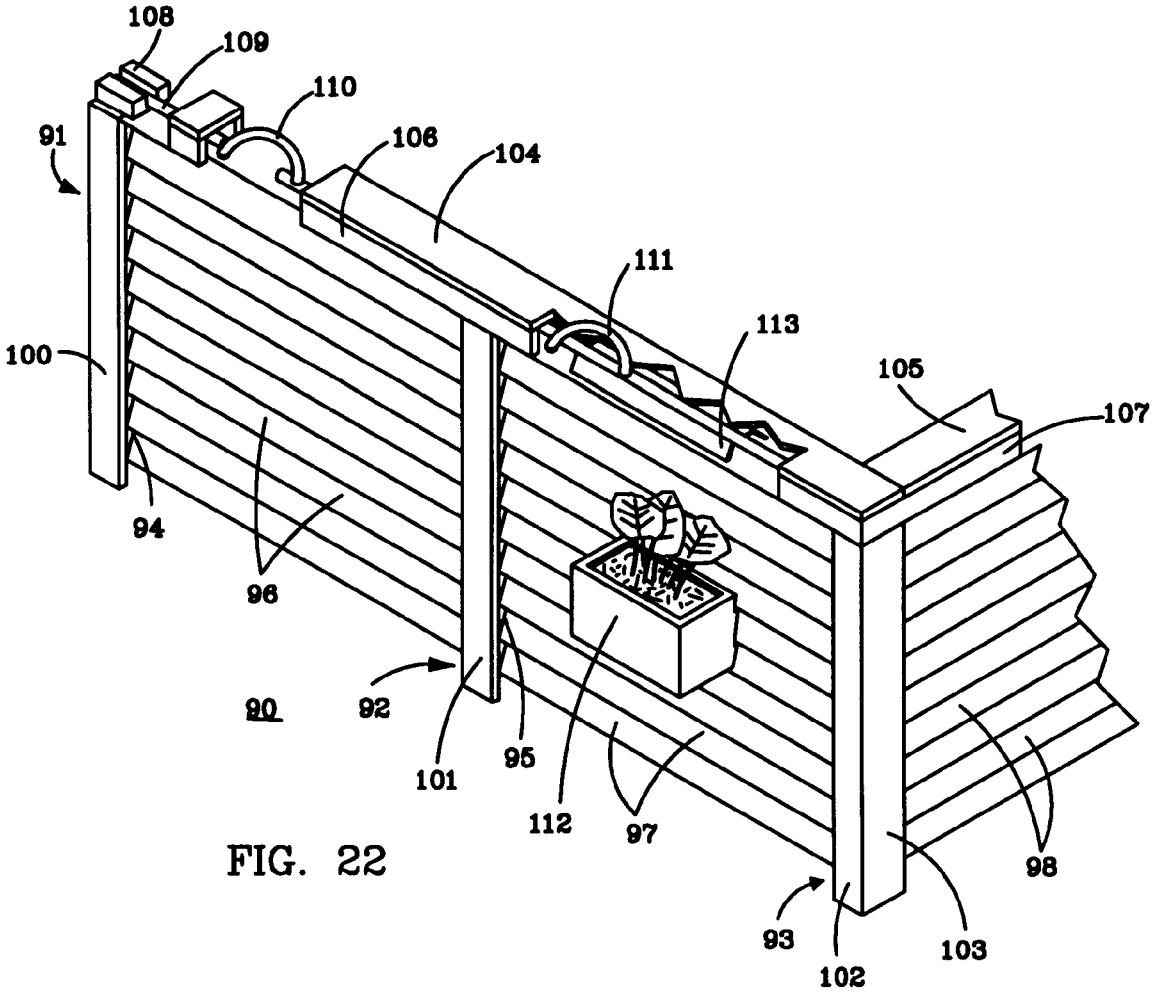
FIG. 22 shows several sections of the fence system.

FIG. 22 illustrates an example of fence 90 using the novel features of the invention. Three post 91, 92, and 93 are shown, post 93 being a corner post. Post 91 has a slat attachment device 94, post 92 has an attachment device 95, and post 93 has attachment devices on adjacent sides (not illustrated). Trim boards 100, 101, 102 and 103 cover the attachment devices and hold the slats 96, 97 and 98 in place.

The top of fence 90 is trimmed with boards 104 and 105, and the edges of the top trim is covered with boards 106 and 107. A post cap 108 has a water line 109 extending through it and along the top of the fence. Misting nozzles 110 and 111 are attached to water lime 109 and provide moisture to any plants along the fence, including flower box 112. A low voltage light 113 may also be mounted under the fence trim 104,106 to provide indirect lighting.

Various example have been given of the various fence system components, but there may be variations. The slat attachment device illustrated in FIGS. 1–6 have been shown to be double units, but single units or double units, one at an angle to the other may be made depending upon the fence configuration. The various shapes and sizes of the components depend, for example, on the size of the fence slats. Other variations may be made without varying from the scope and intent of the invention.

What is claimed:

1. A fence system, comprising:

fence posts;

a plurality of fence slats extending horizontally between the fence posts;

an independent attachment strip for attaching to each post, each attachment strip having a plurality of mounting slots, each slot for receiving the end of a fence slat; and a panel extending the length of and attached to each attachment strip, holding the fence slats in position.

2. The fence system according to claim 1, wherein the mounting slots in said independent attachment strip are inclined from a vertical axis.

3. The fence system according to claim 1, wherein the attachment strip for each fence post is integral with the post.

4. The fence system according to claim 1, wherein said independent attachment strip is separable into two strips.

5. The fence system according to claim 1, including a cap for each fence post, said cap including a channel for installing electrical cable and a water line.

6. The fence system according to claim 5, where in said cap includes an insert device, when used with a metal fence post, and a wedge device attached to said cap by a screw, said wedge device locking said cap to the post by pulling the wedge device up into said insert device to lock the cap to the post.

7. The fence system according to claims 6, wherein a top rail is placed along the top of the fence system and is secured to caps on adjacent fence post.

8. The fence system according to claim 1, wherein said fence post includes a base to allow the post to be free-standing.

9. The fence system according to claim 1, including a fastener clip for securing two fence slats together.

10. A fence system, comprising:

fence posts, each fence post having adjacent sides and a face side;

a plurality of fence slats extending horizontally between adjacent sides of the adjacent fence posts;

an independent attachment strip for attaching to the face side of each post, each attachment strip having a plurality of mounting slots, each slot for receiving the end of a fence slat, the mounting slots in said attachment strips are inclined from a vertical axis; and a panel extending the length of and attached to each attachment strip, holding the fence slats in position.

11. The fence system according to claim 10, wherein the attachment strip for each fence post is integral with the post.

12. The fence system according to claim 10, wherein said independent attachment strip is separable into two strips.

13. The fence system according to claim 10, including a cap for each fence post, said cap including a channel for installing electrical cable and a water line.

14. The fence system according to claim 13, where in said cap includes an insert device, when used with a metal fence post, and a wedge device for attached to said cap by a screw, said wedge device locking said cap to the post by pulling the wedge device up into said insert device to lock the cap to the post.

15. The fence system according to claims 14, wherein a top rail is placed along the top of the fence system and is secured to caps on adjacent fence post.

16. The fence system according to claim 10, wherein said fence post includes a base to allow the post to be free-standing.

17. The fence system according to claim 10, including a fastener clip for securing two fence slats together.

18. A fence system, comprising:

fence posts;

a plurality of fence slats extending horizontally between the fence posts;

an independent attachment strip for each post, each attachment strip having a plurality of mounting slots, each slot for receiving the end of a fence slat, the mounting slots in said attachment strips are inclined from a vertical axis;

a cap for each post to provide a mount for a top rail for the fence system; and a panel extending the length of and attached to each attachment strip, holding the fence slats in position.

19. The fence system according to claim 18, where in said cap includes an insert device, when used with a metal fence post, and a wedge device attached to said cap by a screw, said wedge device locking said cap to the post by pulling the wedge device up into said insert device to lock the cap to the post.

* * * * *